US005842959A

United States Patent [19]

Wilkinson

[11] Patent Number: 5,842,959

[45] Date of Patent: Dec. 1, 1998

[54] ENERGY EXPENDITURE GARMENT

[76] Inventor: William T. Wilkinson, P.O. Box 73, Salem, N.J. 08079

[21] Appl. No.: 944,517

[22] Filed: Oct. 6, 1997

[51] Int. Cl.[6] ..... A63B 21/02

[52] U.S. Cl. ..... 482/121; 482/124; 482/125; 2/69

[58] Field of Search ..... 2/69; 482/121, 482/124, 125

[56] References Cited

U.S. PATENT DOCUMENTS

| | | |
|---|---|---|
| 1,178,165 | 8/1916 | Lupton . |
| 2,097,376 | 10/1937 | Marshman . |
| 2,613,932 | 10/1952 | Manners . |
| 3,411,500 | 11/1968 | Gatts . |
| 3,559,654 | 2/1971 | Pope . |
| 3,759,510 | 9/1973 | Jackson . |
| 4,065,814 | 1/1978 | Fox . |
| 4,220,299 | 9/1980 | Motter . |
| 4,325,379 | 4/1982 | Ozbey . |
| 4,384,369 | 5/1983 | Prince . |
| 4,670,913 | 6/1987 | Morell . |
| 4,698,847 | 10/1987 | Yoshihara . |
| 4,910,802 | 3/1990 | Malloy . |
| 4,953,856 | 9/1990 | Fox . |
| 4,961,573 | 10/1990 | Wehrell . |
| 4,968,028 | 11/1990 | Wehrell . |
| 4,993,705 | 2/1991 | Tolle . |
| 5,033,123 | 7/1991 | Audet . |
| 5,046,194 | 9/1991 | Alaniz . |
| 5,060,315 | 10/1991 | Ewing . |
| 5,062,642 | 11/1991 | Berry . |
| 5,109,546 | 5/1992 | Dicker . |
| 5,141,223 | 8/1992 | Block . |
| 5,176,600 | 1/1993 | Wilkinson . |
| 5,186,701 | 2/1993 | Wilkinson . |
| 5,201,074 | 4/1993 | Dicker . |
| 5,203,754 | 4/1993 | Maclean . |
| 5,256,119 | 10/1993 | Tudor . |
| 5,263,916 | 11/1993 | Bobich . |
| 5,267,928 | 12/1993 | Barile . |
| 5,282,277 | 2/1994 | Onozawa . |
| 5,306,222 | 4/1994 | Wilkinson . |
| 5,308,305 | 5/1994 | Romney . |
| 5,336,139 | 8/1994 | Miller . |
| 5,357,637 | 10/1994 | Moore . |
| 5,367,708 | 11/1994 | Fujimoto . |
| 5,372,565 | 12/1994 | Burdenko . |
| 5,375,610 | 12/1994 | Lacourse . |
| 5,383,235 | 1/1995 | Peters . |
| 5,465,428 | 11/1995 | Earl . |
| 5,518,480 | 5/1996 | Frappier . |
| 5,518,481 | 5/1996 | Darkwah . |
| 5,570,472 | 11/1996 | Dicker . |

*Primary Examiner*—Lynne A. Reichard
*Attorney, Agent, or Firm*—Connolly & Hutz

[57] ABSTRACT

An energy expenditure garment is worn underneath outer clothing continuously for an extended period of time during which the user would perform physical activities which are dominantly non-anaerobic so as to burn more calories than would be burned if the resistance garment were not being worn.

25 Claims, 3 Drawing Sheets

3.5 mph/0% Grade

ENERGY EXPENDITURE GARMENT

BACKGROUND OF THE INVENTION

Aerobic exercise and weight loss are two of the major concerns of the public. The two are related, since aerobic exercise burns calories, and thus promotes weight loss. Current exercise and weight loss findings emphasize the value of exercising moderately, and losing weight gradually and evenly over time. Exercise and weight loss in smaller increments, on a regular basis lowers the risk of injury, is more tolerable, and promotes a safer and more sustainable workout and weight control program.

U.S. Pat. No. 3,759,510 describes an exercise garment including a helmet, jacket, armlets, gloves, belt, shorts, thigh leggings, calf leggings and boots with these components being detachably connected together for the use of a total composite garment or for the use separately in various combinations, each component of the total garment having exterior pockets which may be filled or partially filled with a particular weight material of various densities. This exercise garment is cumbersome and should be worn on the outside, not underneath the clothes.

U.S. Pat. No. 5,033,123 relates to a garment which comprises a pair of trousers and optionally a solid upper jacket to form a combination suit. This garment is worn in such activities as lumbering and sporting where consider body bending is involved. These trousers and jacket are worn on the outside, not as an undergarment.

U.S. Pat. No. 5,109,546 relates to an exercise suit with form fitting pants and pull-over top made of stretchable material having reinforcing segments with helically wound leg and arm resistance bands attached integrally to the suit.

U.S. Pat. No. 3,559,654 relates to a wearing article having heavily stretchable and easily stretchable portions. The heavily stretchable portions support relevant muscles.

U.S. Pat. No. 3,559,654 relates to a combination girdle and stockings using fabric made of yarn having different elastic characteristics.

It is a primary purpose of the invention to create an energy expenditure garment that while comfortable, causes the wearer to gradually elevate his (her) heart rate, and thus consume more calories over an extended period. Thus, this garment is designed to be worn primarily as an undergarment (such as underwear), and to be worn for a longer time, typically longer than a workout, such as during the entire workday. It is intended to be worn when not exercising. However, it is also possible with or without slight modifications to wear this garment during exercising.

SUMMARY OF THE INVENTION

An object of the invention is to provide an energy expenditure garment to promote weight loss, by creating safe, modest and comfortable resistance load on the body during normal, everyday activities.

Another object of the invention is to provide such a garment to give added aerobic exercise, to strengthen the heart, during exercise and sports activities.

Another object of the invention is to strengthen and tone the body muscles.

Another object of the invention is to provide an exercise program that would permit a user to exercise while wearing the garment of this invention.

Another object of this invention is to provide a weight loss program, whereby a user can wear different thicknesses of the resistance garment by starting out with a thin garment and increasing to a thicker garment, thereby being able to gradually elevate the users heart rate and consume more calories over an extended period of time.

Another object of the invention is to create a garment, that while comfortable, causes the wearer to gradually elevate his heart rate, and thus consume more calories over an extended period to exceed 1 or 2 or 8 hours over the cumulative caloric burn.

The garment is designed to be worn as an undergarment such as shorts and a tee shirt and to be worn for a longer time than a workout, such as during the entire workday. This garment can be worn but is not intended to be worn while exercising.

Another embodiment of this invention is drawn to a garment that can be worn over the clothing or underneath the clothing and over undergarments and provides resistance, thereby increasing the muscle tone of the user.

With respect to the first object, inducing a slight load over time, the cumulative daily result is substantial but yet easily tolerated by the user.

The invention also relates to a process for burning calories comprising a user placing the garment on and wearing the garment for an extended period of time, thereby burning calories and after the user achieves the desired result, the user increases the level of calorie burning by changing the garment to a garment of greater resistance or by adjusting the resistance of the garment. The activities performed by the user while wearing the garment would be dominantly aerobic, rather than anaerobic.

DETAILED DESCRIPTION

Figure 1:
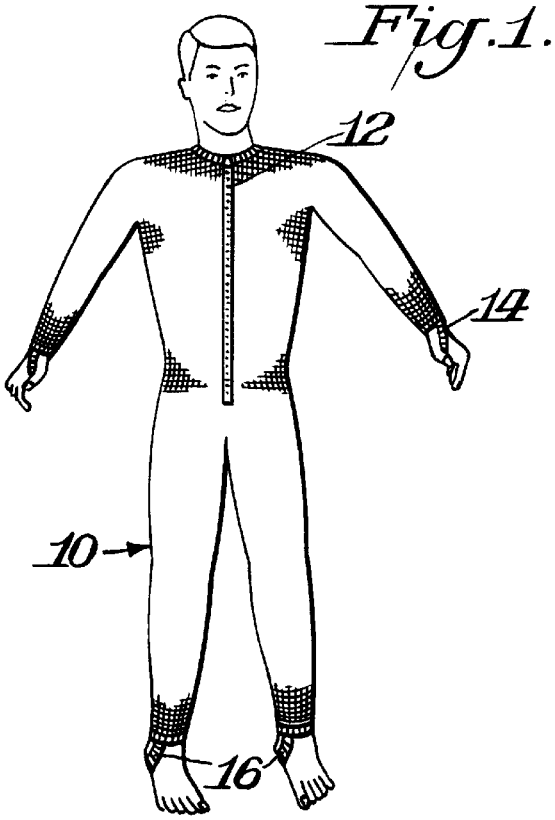
FIG. 1 shows a front elevational view of a one-piece resistance garment according to this invention.

The present invention is based upon the recognition that it is possible to create conditions tending to result in a weight loss by a person wearing an energy expenditure garment over an extended period of time which would result in a greater expenditure of energy doing normal activities than would result where the same activities might otherwise be done over the same period of time without wearing the garment. Such a garment is intended to offer resistance to various movements of portions of the body during the activities. Given this recognition the invention may be practiced using various types of energy expenditure garments. Such garments may include, for example, the types of garments disclosed in U.S. Pat. Nos. 5,109,546, 5,176,600, 5,186,701, 5,209,074, 5,306,222, and 5,507,472 and in co-pending patent application nos. 27,426 filed Apr. 4, 1996, Ser. No. 761,290 filed Dec. 6, 1996, Ser. No. 802,972 filed Feb. 20, 1997 and Ser. No. 08/840,917 filed Apr. 25, 1997. All of the details of those patents and applications are incorporated herein by reference thereto.

In its preferred practice the garment would be worn over an extended period of time wherein the activities of the wearer are dominantly aerobic as distinguished from anaerobic (i.e. dominantly non-anaerobic) . The invention may be practiced where some of the activities are of an aerobic nature, but in order to obtain better benefits from the invention a higher degree of aerobic activities would be done. The extended period of time could be as short as one hour or less but is preferably at least two hours and more preferably at least eight hours, although it could also be four hours or six hours. The following discussion points out the differences between aerobic and anaerobic activities.

Aerobic means that all of the metabolic oxygen requirements of the active tissues of the body are being fully met by the oxygen supplying transported in the blood at that time. Activity levels that stay within these requirements are classified as aerobic and last beyond 5–7 minutes of continuous, rhythmic exercise. The principal fuels are fat and sugar, and the predominant by-products are $CO_2$, $H_2O$, heat and large quantities of ATP.

Anaerobic means that the metabolic oxygen requirements of the active tissues of the body exceed the oxygen supply being transported in the blood at that time. Any aerobic activity can become an anaerobic activity if the intensity of the exercise becomes increasingly harder so that the oxygen requirement of the active body tissues begins to exceed the blood's oxygen supply. High intensity activities that can only be sustained for periods of time less than 5–7 minutes fit the anaerobic classification. The principal fuel is sugar, and the predominant byproduct is lactic acid.

These two definitions apply to any physical activity used by a person whether it is sleeping, walking, running, cycling, weight training, power lifting, or sky diving. Metabolically, people are never perfectly aerobic, nor ever perfectly anaerobic. The body's function more dominantly in one condition than the other based on the intensity or the duration of the activity in which people are participating.

During aerobic activity, the muscular demand for oxygen is always less than the supply of oxygen being delivered by the body's circulatory system. The subject is able to work comfortably for long periods of time without experiencing undue respiratory distress, muscular discomfort, or muscular failure. The primary fuel sources for maintaining this aerobic condition are fat (triglyceride) and sugar (carbohydrate/glucose/glycogen).

During resting conditions, the ratio is roughly ⅔ fat and ⅓ carbohydrate with a trace of protein. Both provide the necessary ATP (potential high-energy molecule) that the muscles use for their contraction process. As long as the oxygen supply tot he active tissues is equal to or greater than the metabolic requirement, glucose molecules are actively transported into the muscle via insulin while the free fatty acid (FFA) molecules freely cross the cell membranes. Sugar (glycogen) previously stored in the muscle cells is added to the potential fuel supply.

Once inside the cell, cellular enzymes dismantle the molecules into carbon, hydrogen, and oxygen. The oxygen and carbon combine to form $CO_2$ which is returned to the lungs via the blood stream for us to exhale. The remaining hydrogen ions are shuttled by active transporters called NAD and FAD into the small energy-producing organelles called mitochondria. The hydrogen and oxygen combine to form $H_2O$ which we eliminate through sweating, breathing, our intestines and bladder. The heat produced during the enzyme activity maintains our body core temperature and elevates it during exercise. Large quantities of the high energy ATP are produced to sustain prolonged, continuous muscular activity (36–38 per molecule of glucose/glycogen and 100s per molecule of fat).

As the intensity of muscular activity increases, the oxygen requirement increases; body core temperature elevates; the brain signals the adrenal medullas to secrete epinephrine (adrenaline); blood delivers the epinephrine throughout the body; the epinephrine stimulates the Beta-receptors of fat cells (adipocytes) by triggering internal adipocyte lipase to dismantle the stored triglyceride into FFA's and glycerol. the muscles use the FFA's as previously described, and the liver catabolizes the glycerol and reduces it to $H_2O$ and heat, both of which we eliminate.

Aerobic activities include sleeping, sitting, and exercise activities that produce heart rates that are 85% or less of one's estimated maximum rate. Roughly estimated, this is 170–160 bpm for people 20–30; 153–145 for 153–145 for people 30–50, and above age 50 it's 140–128. Above 85%, the body's demand for oxygen beings to overtake the blood's oxygen supply, and a person begins the transition into anaerobic dominance. The change-over can be easily documented using laboratory metabolic analyzer systems, but this is not practical for the average person. The simplest method is to monitor one's own breathing process during exercise. If it's easy to speak to someone while exercising, then one is dominantly aerobic. If one has to use a halting speech pattern due to the need for frequent breaths, then one is in transition. If getting a breath of air is more important than speaking, then one is dominantly anaerobic.

Short-Burst Activity. Activities that last less than 10 seconds do not produce lactic acid, and they do not utilize glycogen (sugar stored in the muscle). ATP that has been previous produced by aerobic and anaerobic activity and has been stored in the muscle is used for such short-burst activities. Examples include blinking one's eye, twitching a finger, exploding out of starting blocks in a track event, sprinting 35 yds (i.e., football drills), or 1–3 maximum repetitions in power lifting.

The ATP is split by an enzyme to release the potential energy in the compound. Within microseconds upwards to 30 seconds, the ADP and the separated terminal phosphate are re-united by creatine phosphate to re-create another ATP molecule to be used again. The liberated energy is used for muscular contraction and resynthesis of ATP.

See Table 4.3 from Roberg & Roberts, *Exercise Physiology*, Mosby, 1996, column CrP (creatine phosphate) dependence. Examples of short-burst sports activities that use this system are cited.

muscle contraction

ATP→ADP+Pi energy

ATP←ADP+Pi creatine+energy 3- to 5- Minute High Intensity Activity. High intensity muscular activity exceeding 10 seconds requires more oxygen than the blood can supply to the active muscle tissues. This hypoxic (insufficient oxygen) condition activates an enzyme in the muscle cell which interrupts the aerobic sugar and fat metabolism pathway. One molecule of stored muscle sugar (glycogen) and one molecule of the blood sugar (glucose) entering the cell are converted to two molecules enzyme reduces each pyruvic acid molecule into two molecules of lactic acid=8 LA. Minimal amounts of ATP are produced (2 molecules per glucose and 3 per molecule of glycogen).

This snowball effect quickly increases the lactate concentration, further increasing the anaerobic enzyme activity to produce more lactate. Lactic acid spilling over into the blood stream is circulated to fat cells and impairs the stimulation of fat cell lipase by the circulating adrenaline. Fat cell triglyceride is not released into the blood stream which deprives the muscle cells of a supply of fat for their aerobic use. The reduction in available fat shuts down the aerobic activity of the ATP-producing muscle mitochondria. Increasing the exercise intensity, depriving the muscle mitochondria of fat and oxygen, increasing the lactic acid concentration all stimulate the increased activity of the anaerobic enzyme activity. The process is a cycle that feeds itself until there is not enough ATP to continue driving the muscle. The result is muscle fatigue and failure.

Heart rates exceeding 90% of one's estimated, age-adjusted maximum typically accompany anaerobic metabolism dominance. For deconditioned to moderately conditioned subjects, 90% is roughly estimated to be greater than 180–170 bpm for people 20–30; 170–153 for people 30–50, and 153 and lower above age 50. As previously noted, the simplest method for determining if one is approaching dominantly anaerobic levels is to monitor one's own breathing process during exercise. If getting a breath of air is more important than speaking, the one is dominantly anaerobic.

Even during this type of high-intensity work, we are still note perfectly anaerobic. While muscles in one part of the body are working aerobically, others are working anaerobically. When the preponderance of muscle tissue is working anaerobically, the ratio of sugar and fat use switches to ¼ fat and ¾ sugar (see the aerobic ratio).

See Table 4.3 from Roberg & Roberts, *Exercise Physiology*, Mosby, 1996, column GLYCOLYSIS dependence. Examples of typical high-intensity sports activities that use this system are cited.

The following relates to tests on a garment (referred to as Power Gear which may be used in the practice of the invention such as of the type described in Ser. No. 808,972.

POWER GEAR PROTOCOLS

During all Power Gear suit test sessions, a modified McHenry treadmill walling protocol (Table 1) was used. The workload settings involved a constant, easy-gaited walking pace of 3.5 mph and elevations of 0, 3, and 6%. Subjects were fitted with a head bracket, pulmonary breathing valve, and noseclip. All expired air from the subjects passed through a MedGraphics model 2001 metabolic cart containing oxygen and carbon dioxide sensors and an air flow transducer. The AGC 2001 internal computer/software provided breath-by-breath analyzes of the metabolic cost (oxygen uptake) of exercise in Power Gear suits. The AGC monitor-displaed breath-by-breath data which permitted instant updates of the evolving data. Computer printouts provided averaged oxygen uptake ($VO_2$ ml•ekg$^{-1}$ •min$^{-1}$) in 20-second intervals. Each successive model of the Power Gear suit was tested under the same conditions and treadmill workloads to maintain reliable/comparative results. A 2-way Analysis of Variance statistical package determined if in fact a statistical difference existed between control and experimental conditions. When significant F ratios were derived, A sheffe post hoc test was used to determine where the significant difference existed.

TABLE 1

Modified McHenry Treadmill Walking Protocol

| Stage | Duration (min) | Elapsed Time* (min) | Speed (mph) | Grade (%) |
|---|---|---|---|---|
| 0 | 2 | 2 | 0 | 0 |
| 1 | 2 | 4 | 2.5 | 0 |
| 2 | 15 | 19 | 3.5 | 0 |
| 3 | 3 | 22 | 3.5 | 3 |
| 4 | 3 | 25 | 3.5 | 6 |
| 5 | 3 | 28 | 2.5 | 0 |

*Elapsed walking time = 26 minutes

Table 2 provides the heart rates for subjects age 20–30 and subjects age 45–56 .

TABLE 2

Heart Rates During 3.5 MPH/0–6% Grade Walking

| Subject Ages | 0% HR bpm | 3% HR bpm* | 6% HR bpm** |
|---|---|---|---|
| 20–30 | 94–136 | 104–143 | 122–154 |
| 45–55 | 73–122 | 94–137 | 101–147 |

Figure 10:
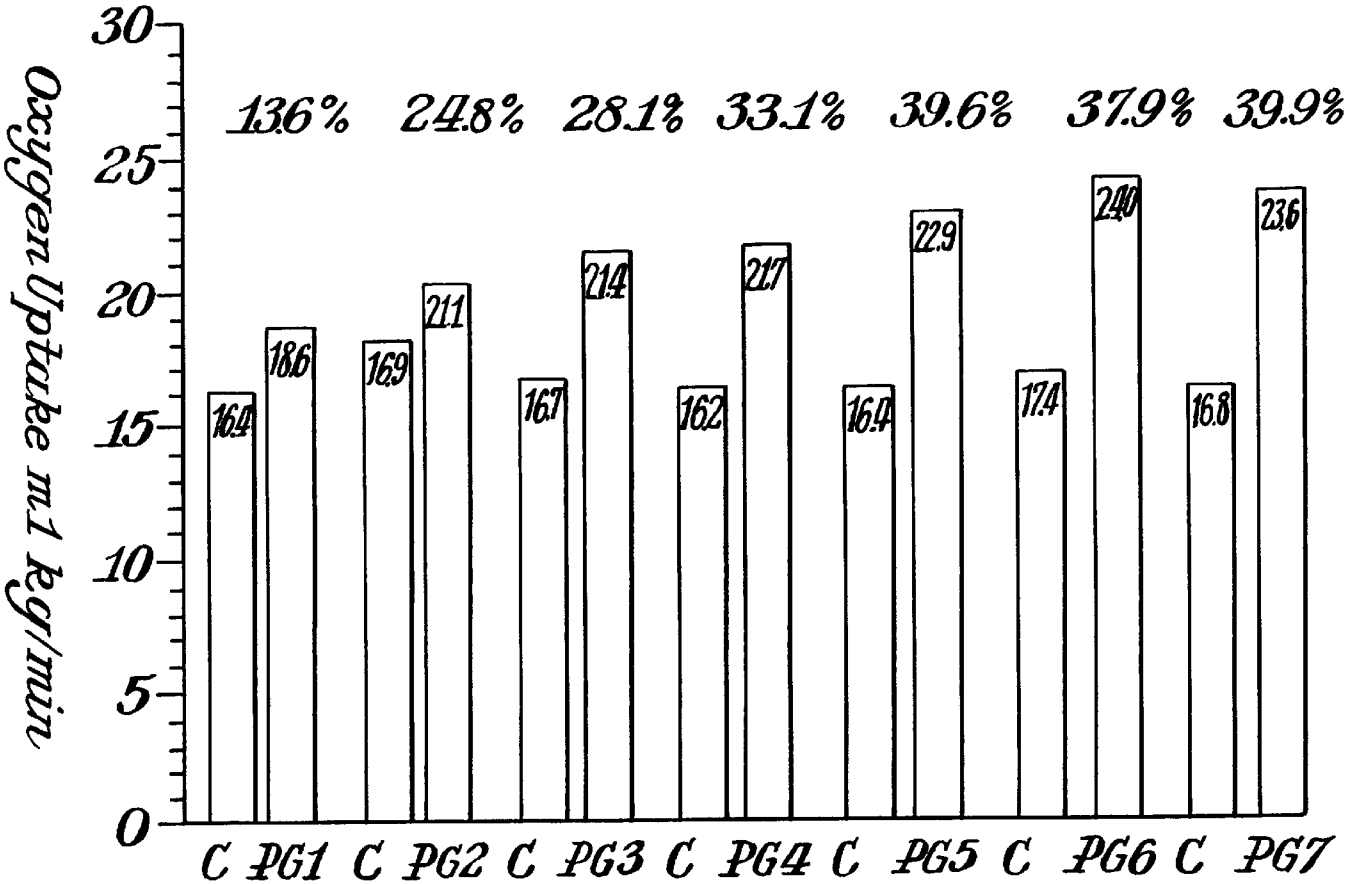
FIG. 10 is a graph showing the metabolic cost of exercise for seven different garments in accordance with this invention compared to each control condition.

*Heart rates <.85% of estimated, age-adjusted maxHR
Heart rates <.90% of estimated, age-adjusted maxHR Power Gear Testing Results FIG. 10** summarizes the research findings for seven successive models in the development of Power Gear. The graph displays vertical bars for each Power Gear suit model (designated PG1, PG2, PG3, etc.) in comparison to the required control condition of exercise (designated C) without Power Gear. Each bar represents the aerobic oxygen cost in ml•kg$^{-1}$•min$^{-1}$ The percent increase in the metabolic cost for the subjects created by Power Gear over the control conditions are located above each Power Gear bar (PG1, etc.). As testing continued and modifications were made to the Power Gear suits, the percent increase in energy expenditure above the no-suit exercise control condition rose from 13.6 to 39.9%. A distinctly significant rise in energy expenditure can be seen for Power Gear suit models 5, 6 and 7.

Conclusions—Power Gear Testing

Based on the heart rates provided in the previous section entitled 3- to 5- Minute High Intensity Activity and the fact that the subjects in the Power Gear testing sessions for each updated model of the suit walked for a period of 31 minutes, the following conclusions can be made.

1. Exercising in a Power Gear suit at a constant 3.5 mph on a 0% grade produced heart rates that were less than 74% of estimated, age-adjusted maxHR and were within the metabolic guidelines for aerobic activity.
2. Exercising in a Power Gear suit at a constant 3.5 mph on a 3% grade produced hear rates that were less than 85% of estimated, age-adjusted maxHR and were within the guidelines for aerobic activity.
3. Exercising in a Power Gear suit at a constant 3.5 mph on a 6% grade produced hear rates that were less than 90% of estimated, age-adjusted maxHR and were within the guidelines for aerobic activity.

Standardized guidelines for prescribing aerobic exercise for clients and patients is 70–85% of one's age-adjusted maxHR.

Most city and state sidewalks and highway codes recommend 5 percent grades of 0–3% and occasionally 6% if the terrain dictates such. Normally, people who exercise do not encounter 5 grades when walking outside. Municipal and state codes are also generally made for a maximum of a 10% grade for bridges and uphill grades on highways.

4. Subjects exercised in a Power Gear suit for 26 continuous minutes which corresponds to the metabolic/time requirements for aerobic activity which is continuous, rhythmic activity in excess of 7 minutes.

Standard guidelines for prescribing aerobic exercise for clients and patients is 20–30 minutes of continuous, rhythmic activity. This allows body temperature to rise, adrenaline to circulate in the bloodstream, fat to be mobilized from the fat cells, and the mitochondria of the muscle tissues to catabolize body fat. The metabolic waste products of burning the mobilized fat and sugar is $CO_2$, $H_2O$, heat and ATP, which over time, contributes to body fat/weight loss. The ratio of fat use during aerobic exercise is roughly ⅔ of the fuel available to active muscles.

It is not the purpose of the clothing aspects of the garment to contribute to a weight loss. Rather, the resistance bands strategically built into the clothing become the vehicles for increasing the aerobic energy expenditure of a user. This in turn does contribute to higher energy expenditures, which in time, can produce weight loss. By itself, for example, a stationary exercycle also does not contribute to a weight loss unless the resistance-producing tension is applied to the weighted flywheel for the user to work against.

As previously discussed, one is never perfectly aerobic or anaerobic. With the exception of the creatine phosphate (CrP/phosphogen) system with lasts roughly 10 seconds at the beginning of exercise, fat is catabolized (burned) during both aerobic and anaerobic activity. Fat predominantly contributes to the fuel supply required by the muscles during aerobic work. The ratio shifts to carbohydrate as one's muscles begin dominantly working under more anaerobic metabolic conditions.

A typical anaerobic activity is really referring to the physiological responses to weight lifting and/or power lifting which are specifically used to increase muscle mass in varying degrees based upon the principles of overload and volume. Under extreme overload conditions, all aerobic activities can also become predominantly anaerobic activities. Referring to the Research Protocols and the Results and Conclusions sections of the testing program previously described, one can note that the subjects were not exercised into the "extreme overload" situation that would elicit anaerobic activity. To produce an aerobic, metabolic, fat-burning environment as well as an endurance producing workout within the human body, one must apply moderate to heavy overload to force the muscles to increase their work which requires more oxygen and body fat. This standardly applied, basic aerobic principle is accomplished as described in four of the most common modalities (equipment) used for exercising.

Bicycles: Either the tension on the flywheels, or the pedaling rate is increased to force the muscles to work harder.

Rowing machines: The resistance on the oars is increased, or the rowing rate is increased to force the muscles to work.

Stair Climbers: Resistance is increased to slow the stepping rate which makes the user push harder on the pedals or steps to maintain a pre-selected stepping rate. This increases the muscular work.

Aerobic Dance/

Step Aerobics: To increase overload to generate higher aerobic activity, body movements become more dynamic, and the timing of the music is increased. Users of the step benches are required to traverse the entire bench front to back, side to side, off and onto the bench while incorporating more dynamic body movements.

As used in the method of this invention, the garment applies the same basic principles of overload. The user increases his/her effort against the intrinsic resistance of the garment by increasing stride length, speed of walking, or the dynamics of the arm movements. It is not the garment but the strategically placed, built-in resistance bands or sections that require the user to exert more physical effort during their exercise movements as they kinesthetically perceive the resistance to joint flexion and extension. Because a user of the four modalities described above wants to sustain exercise for fat-burning purposes, he/she intentionally works harder against the applied resistance but at an overload level that allows them to exercise continuously for 20–60 minutes. The same holds true in regard to the intrinsic resistance band tension sensed by the user of the garment.

Sleeping, sitting, standing, bathing, and walking are aerobic activities. the degree of effort put forth in each determines the magnitude of aerobic response. The basic principle in body weight (fat) loss involves increasing one' daily caloric expenditure beyond what is required by one's "normal" daily activities. In other words, one must force one's body to perform more aerobic physical work throughout a day so that the accumulative caloric expenditure exceeds one's caloric intake. The Power Gear suit or garment as used in seven (7) separate laboratory investigations did stay within standard aerobic guidelines and produced 26 minutes of continuous aerobic activity with oxygen uptake values that can be converted into calories expended.

The protocol for determining oxygen uptake (reflective of caloric/energy expenditure in one's muscles) used in the Power Gear investigations; the mathematical calculation of caloric expenditure by using the oxygen uptake findings, and conversion of those calculations into potential body fat loss are standardly used in the fields of Nutrition and Dietetics, Exercise Physiology, and Cardiac Rehabilitation to project weight loss for clients, subjects, and patients.

Projecting possible body fat loss is precisely what we do when we decide that we want to loss weight by electing to exercise. We apply the four basic exercise guidelines in establishing an exercise program for ourselves by including aerobic Activity Type, hear rate Intensity, exercise Duration, and exercise Frequency. We then choose an exercise modality that will help us elicit the excess caloric expenditures we desire, and we project the weight loss that we desire.

The intrinsic, strategically placed resistance bands within the Power Gear garment add to the effort required to extend and flex those joints of the body that are predominantly involved walking and/or running-type activities. As previously described, the research protocols used in testing Power Gear involved waling on a treadmill at a constant 3.5 mph at 0%, 3%, and 6% grades while the metabolic cost was being measured by calibrated oxygen and carbon dioxide analyzers. the exercise protocol was designed to stay within the aerobic capacities of the subjects as well as the standard guidelines for an aerobic exercise. A direct comparison o the aerobic effects of the Power Gear resistance bands to those of the control conditions were statistically made. The results were statistically significant increases in caloric expenditure above the control conditions.

FIG. 1 illustrates a one-piece resistance garment according to this invention. The one-piece resistance garment 10 is made from a stretchable material. In addition, the stretchable material can be, but is not limited to, an all mesh material; mesh material with web or solid panels; all web material; web material with solid elastic strips or panels; or all elastic material for comfort, coolness and lightweight. The elastic material can be, but is not limited to nylon, an elastic synthetic fiber known as LYCRA® sold by the DuPont Company, SPANDEX® sold (stretch fiber based on synthetic elastomeric long-chain polymers, the fiber returns to the original length after being stretched several times) or neoprene rubber. The garment can be manufactured in any known method to achieve one or more directional lines of stretch including, but not limited to, the warp knit, circle knit, weft insertion, continuous weave/variable density strips (the fabric is of continuous weave having fabric made from strips of different densities and elasticities). The panels can be on the garment, in the garment such as but not limited to being sewn into the garment, incorporated into the weave and made an integral part of the garment (of the same weave of the garment). The strips can be of the same material or of a different material from the garment.

There can be an access means 12, such as, but not limited to, any known attachment means such as, but not limited to, a zipper, buttons, snaps, clips or hook and loop tape known by its registered trademark VELCRO®. The access means 12 can be in the front, the back and/or the sides to permit easy entry into and removability of the garment 10. As shown in FIG. 1, the access means 12 is a zipper in the front of the garment 10.

Figure 4:
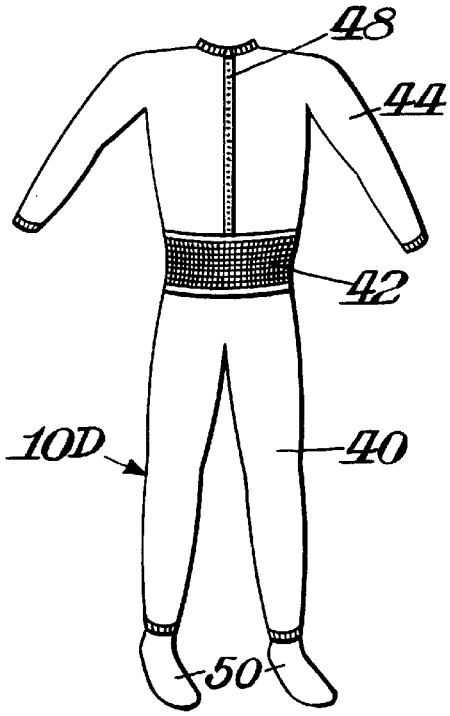
FIG. 4 shows a front elevational view of still another one-piece resistance garment according to this invention.

There would be a means to tighten the garment snugly on the user. One such means can be the material itself. Again, as stated above, the material could be a tight fitting resilient material that would be capable of stretching, thereby permitting the material to fit snugly on a user. In addition, hand stirrup(s) 14 could be attached to the garment 10 to form a snug fit of the garment 10 on the user. There can also be foot stirrup(s) 16 attached to the bottom of the legs of the garment 10. The hand stirrup(s) 14 and the foot stirrup(s) 16 would create additional tension on the garment 10, thereby causing the user to bum more calories without the user perspiring. In addition to, or instead of the foot stirrup(s) 16, there could also be socks or other means of attachment to the bottom of legs of the garment 10 such as shoes (as shown in FIG. 4). The garment 10 can also engage the hands with a loop or be attached to a glove or hand stirrup 14 to provide added tension for the upper body. However, it is believed that the engagement of the hands is less preferable and tolerable by the user during prolonged periods of use. Thus, engagement of the hands is more appropriate for the aerobic short term application than for the longer weight loss purpose. In addition, elastic can be built into the garment at varying locations such as in the sleeves, legs, front, back or sides, to permit the garment 10 to snugly fit to the user.

Again, the web, mesh, mat-like fabric has the benefits of being lightweight, comfortable, has coolness and breathability and is capable of being worn in the summer time as well as the winter, spring and fall seasons.

In one practice of the invention garment 10 might be considered a body stocking made of elastic resilient material and anchored at various locations, particularly the ankles and wrists. The anchoring can be by means of (1) shoes/gloves or (2) hand loops or stirrups and foot stirrups or (3) compressive cuffs at the ankles and wrists. Instead of shoes the footwear could be socks. Thus, the anchoring is achieved by securing the arms and legs of the garment to appropriate anchoring elements. Additional anchoring could be by a compressive waistband and by a compressive collar. A compressive cuff, waistband or collar is a compressive band which encircles a portion of the body with greater compressive force than adjacent portions of the garment and with greater compressive force than any tensile force it exerts.

Figure 2:
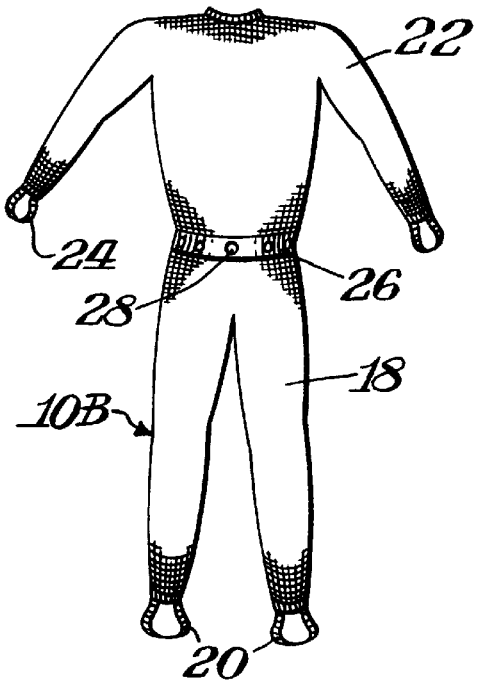
FIG. 2 shows a front elevational view of a two-piece resistance garment according to this invention.

FIG. 2 shows a front elevational view of a two-piece suit according to this invention. The two-piece suit 10B has pants 18 which could be made of a light-weight web, mesh or mat-like fabric for comfort and coolness or it could be a solid fabric construction or a combination of a web and solid pieces as described above for the one piece garment 10. The pants 18 could have a means that would provide extra tension at the bottom of the legs of the pants 18. The tightening means 20 could be, but is not limited to, a sock or foot stirrup connected to the pants. The user would wear the pants and place the user's feet in each of the foot stirrups 20, thereby causing a greater tension, which would pull the garment 10B tighter on the user's body. The upper piece of the suit 10B would be shirt or a top 22. The top 22 could be made of the same material and construction as described above for the one piece garment 10. It is also possible that the top 22 could have an access means as shown in FIG. 1 (access means 12). It is also possible that the top 22 can be a pull-over top without use of an access means. Additionally, hand stirrups 24 can be connected to the top 22. The hand stirrups can be the same as described in FIG. 1, and would enable the top to be pulled tighter on the user and cause the user to create more body heat, and burn more calories and loss more weight. There could also be a waist band 26 that could function as a belt and enable the suit 10B to be further adjusted around the waist of the user. The waist band 26 could also connect the pants 18 to the top 22. The waistband 26 could have an adjusting means 28 to adjust the fit around of the suit 10B around user's waist. The adjusting means 28 can be, but not limited to snaps, VELCRO® or buttons. The waistband 26 is also preferably made from a stretchable material, such as, but not limited to, a elastic material.

Figure 3:
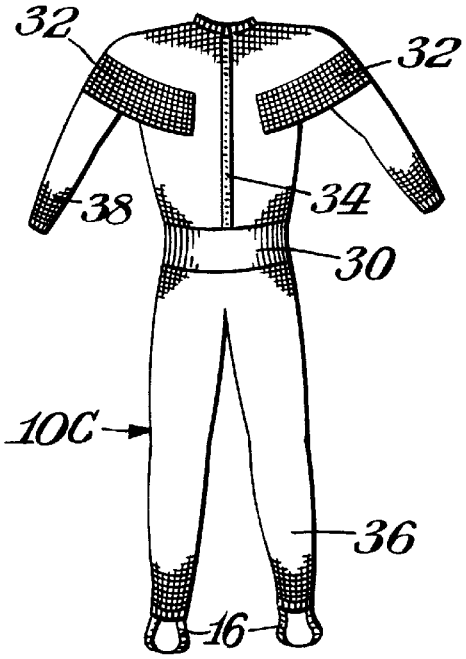
FIG. 3 shows a front elevational view of another one-piece resistance garment according to this invention.

FIG. 3 shows a front elevational view of another one-piece exercise suit according to the invention. The one-piece exercise suit 10C could be made of the same material and configuration as described in the one piece garment of FIG. 1. Around the waist in the exercise suit 10C can be a waistband 30. The waistband 30 can be a solid elastic material causing more tension in the exercise suit. In addition, elastic or a resistance material 32 can be on the upper portion of the exercise suit 10C. The elastic material 32 can be made of a mesh resistant web that would cause greater tension when a user moves his arms away from his body, thereby causing the user to burn up more calories during exercising. In order to get in and out of the suit easier, there could be access means 34 which could be the same as the access means 12 described in FIG. 1. The access means 34 could be in front, back or side of the exercise suit 10C. At the bottom of the legs could be foot stirrups 16 as described above in FIG. 1. The foot stirrups 16 would enable the suit to be pulled tighter against the user thereby creating more tension so that the user can burn more calories. In addition, a tightening means 38 can be at the end of the arms and the end of the legs 36 of the suit to form a snugger fit around the user's ankles and wrists, thereby creating more tension so that the user can burn more calories. The tightening means 38 can be, but is not limited to, having elastic material strips connected or sewn in the sleeves of the material in one direction and optionally have elastic material strips connected or sewn perpendicular to the first set of strips to create a strong elastic band. As described above in FIGS. 1 and 2, stirrups 14, 16, 20 and 24 can also be connected to the suit 10C.

FIG. 4 shows a front elevational view of still another one piece suit according to this invention. The exercise suit 10D can have a solid pair of pants 40 and an elastic mesh mid-section 42 and a solid top 44. There can be an access means 48 to permit the user to have easier access to get in and out of the suit 10D. The access means 48 could be the same as the access means 12 described in FIG. 1. The suit 10D have detachable or permanently connected boots or socks 50. The boots or socks 50 would be made of an elastic material such as, but not limited to LYCRA®, nylon, SPANDEX®, neoprene or rubber.

Figure 5:
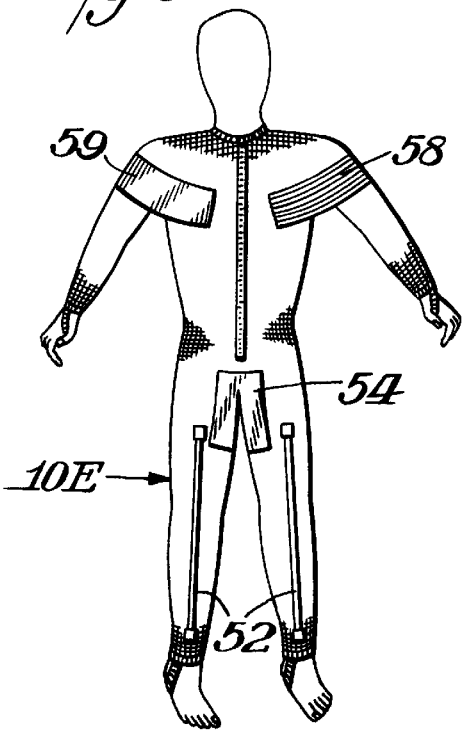
FIG. 5 shows a front elevational view of a further one-piece resistance garment.

FIG. 5 shows a front elevational view of a further one piece exercise suit according to this invention. The exercise suit 10E also has elastic resistance bands 52 attached to one or two of the legs of the suit. The elastic bands 52 which may be mounted beneath or above the suit 10E, preferably however, the bands 52 are formed within the suit by being disposed between individual layers. A similar type of construction is described in U.S. Pat. No. 5,306,222 issued to Wilkinson and the entire patent is incorporated by reference herein. The elastic resistance bands 52 can be adjustable or non-adjustable and would cause greater tension on the user while using the suit, thereby causing the user to bum more calories. The elastic resistance bands 52 can also be attached to the arm sleeves of the top 22. In addition, there could be an elastic web 54 inside the legs or at the crotch of the exercise suit 10E. Again, the elastic web 54 would enable more tension to be created when the user is using the suit 10E, thereby causing the user to burn up more calories. The web 54 can be permanently or detachably connected to the suit 10E. The web and the method of attachment could be similar to that described in U.S. Pat. No. 5,176,600 issued to Wilkinson and is the entire patent is incorporated by reference herein.

Figure 6:
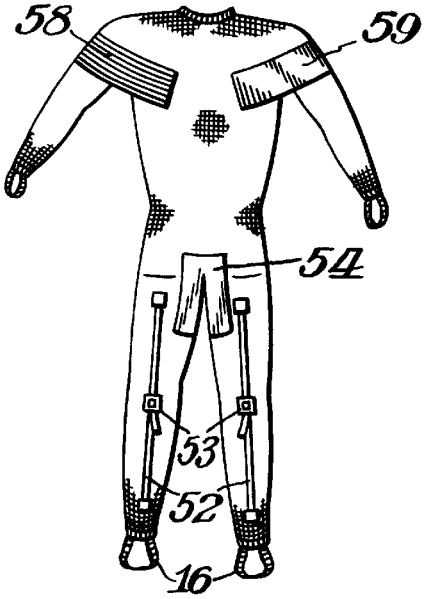
FIG. 6 shows a rear elevational view of FIG. 5.

FIG. 6 shows a rear elevational view of FIG. 5. The resistance garment can also have adjustable elastic resistance bands 52 attached to garment in any location. The elastic bands 52 elastic bands can be attached by any conventional means, such as but not limited to, snaps, buttons, VELCRO® or have the ends glued or sewn into place, etc. The elastic bands 52 have an adjust means 53. The adjust means can be, but is not limited to, a buckle to allow the user to tighten or loosen the resistance bands 52 tension. The bands 52 could be affixed to any desired location on the garment such as across the back, chest, legs or arms or having one end of the resistance band 52 affixed to the back and the other end of the band 52 affixed to the front of the garment. The strands 58 are shown on the upper arm on the body suit. Elastic web 59 is shown also on the other side of the arm of the suit 10E. The elastic strand 58 and elastic web 59 would create more tension thereby enabling the user to burn up more calories. The elastic strand 58 and web 59 would preferably be connected from the shoulders going across the front of the suit where the chest of the user would be. This would provide additional added resistance. It is also possible to provide webs as described in U.S. Pat. No. 5,176,600 issued to Wilkinson and is incorporated by reference herein.

Figure 7:
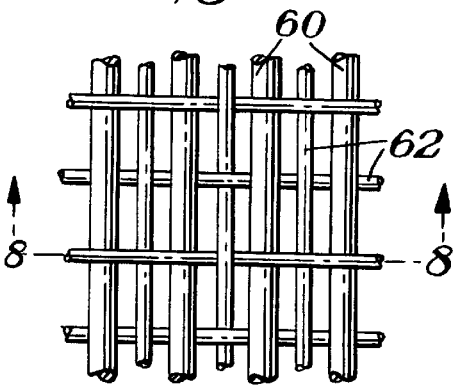
FIG. 7 shows an enlarged fragmental top plan view showing elastic cords sewn into a fabric.

FIG. 7 shows an enlarged fragmental top plan of another embodiment showing an elastic cord 60 sewn directly into the fabric 62. The elastic cord 60 thereby can provide more tension and give the garment greater resistance. As stated above, the elastic cord 60 can be attached to the outside of the fabric, on the fabric, or can be sewn in the fabric as shown in FIG. 7. The elastic cord 60 can be sewn throughout the whole suit, or can be located in specific locations that the user wants to create greater resistance, such as in the chest, or the legs, or shoulders, or back, etc.

Figure 8:
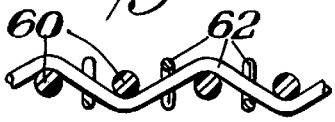
FIG. 8 shows a cross-sectional view in elevation taken along line 8—8 of FIG. 7.

FIG. 8 shows a cross-sectional view in the elevation taken along the line 8—8 of FIG. 7. The woven fabric strand 62 are woven around the elastic cord 60. Thereby forming a suit having greater elasticity in the regions of the elastic coils are placed. It is also possible, instead of elastic cord 60 that a fabric of different material intensity can be sewn into the suit, which is by a continuous weave/variable density strips. This would also provide greater resistance in elasticity.

Figure 9:
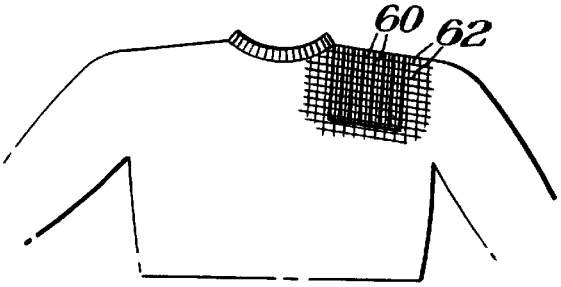
FIG. 9 shows a fragmental view of the upper top portion of an exercise garment showing elastic cords woven into a designated area of exercise.

FIG. 9 shows a fragmental view of an upper portion of an exercise garment showing panels which can be inserted on the garment, or can be sewn into the garment as shown in FIG. 9. The panels can provide greater resistance by being more elastic. The panels can have elastic cord 60 woven into the fabric. In addition, the panels can be continuous woven/variable density strips (as discussed above).

The clothing can come in different strengths and/or degrees of elasticity or thickness as to provide a progressive exercise/weight loss program and system. Thus, when a user becomes accustom to one strength level, the user can increase the aerobic weight loss effect by moving to a higher and greater resistance level. Garments of different elastic resistance strengths also serve to match the individual body strength of the user.

The garment can be worn as follows:

(1) underneath the outer clothing and next to the skin under the underwear of the user, (2) underneath the outer clothing and next to the skin as underwear of the user, (3) underneath the outer clothing but over top of the underwear, (4) as the clothing, (the outer wear) itself or (5) over the top of the clothing/outer wear.

As stated above, the garment can be at least one piece such as, but not limited to pants, shorts, briefs, boxers, long or short sleeve shirts, tank tops, sleeveless tops, vests, brassieres or one piece jump suit including a top and bottom such as an exercise suit covering all or part of the user's arms and legs (full sleeve, short sleeve, no sleeve, full leg, half leg, or above the knee). Preferably the garment is worn as underwear worn directly against the skin without any intervening undershirt and undershorts.

The invention also relates to a process of burning up calories comprising a user wearing the garment for an extended period of time, thereby burning up calories. The user can gradually burn more calories by wearing the garment for a longer period of time or by changing the garment to a garment of greater resistance or of increased thickness and/or by adjusting the resistance of said garment.

While there is shown and described herein certain specific structure embodying the invention, it will be manifest to those skilled in the art that various modifications and rearrangements of the parts maybe made without departing from the spirit and scope of the underlying inventive concept and that the same is not limited to the particular forms herein shown and described.

What is claimed is:

1. A process of wearing an energy expenditure garment for creating conditions for burning calories comprising placing on a user a resistance garment having elongated elastic resistance elements which offer resistance to the movement of portions of a user's body and with the elongated elements having resistance characteristics which differ from other portions of the garment, placing outer clothing on the user over the resistance garment, the user performing physical activities which are dominantly non-anaerobic while wearing the clothing and the resistance garment wherein the dominantly non-anaerobic physical activities include movement of at least some portion of the body having the resistance garment thereon, the resistance elements providing resistance to the movement during the physical activities to tend to burn calories in excess of the calories that are burned during the same physical activities when only the clothing is worn, and wearing the clothing and resistance garment continuously for an extended period of time.

2. The process of claim 1 including wearing the clothing and resistance garment for a period of time of at least four consecutive hours.

3. The process of claim 2 including wearing the clothing and resistance garment for a period of time of at least eight consecutive hours.

4. The process of claim 1 wherein the resistance garment is worn as part of a weight loss program and including the step of changing the resistance garment to a further resistance garment having different resistance characteristics during the weight loss program.

5. The process of claim 1 wherein the resistance garment is worn as underwear placed directly against and in contact with the user's skin without any intervening undershirt and undershorts.

6. The process of claim 2 wherein the elongated resistance elements are located along directional lines of stretch of the garment.

7. The process of claim 6 wherein the elongated resistance elements are located longitudinally on the limb portions of the garment.

8. The process of claim 6 wherein the elongated resistance elements are on the trunk portion of the garment.

9. The process of claim 1 wherein the elongated resistance elements are located longitudinally on the arm portions of the garment.

10. The process of claim 1 wherein the elongated resistance elements are located longitudinally on the leg portions of the garment.

11. The process of claim 1 wherein the resistance garment additionally includes compressive endless bands.

12. The process of claim 1 wherein the resistance garment additionally includes a stretchable waistband.

13. The process of claim 1 wherein the elongated resistance garment includes tightening structure at the ends of the arms and legs of the garment to provide a snug fit in the wrist and ankle portions of the user.

14. The process of claim 1 wherein portions of the resistance garment are made of variable density fabric having multiple sets of strands of different elasticity with one of the sets of strands comprising the elongated resistance elements.

15. The process of claim 14 wherein the variable density fabric is located at spaced portions of the garment.

16. A process for wearing an energy expenditure garment for creating conditions for burning calories comprising placing on a user a resistance garment in the form of a body stocking having elastic resistance elements which offer resistance to the movement of portions of a user's body, placing outer clothing on the user over the resistance garment, the user performing physical activities which are dominantly non-anaerobic while wearing the clothing and the resistance garment wherein the dominantly non-anaerobic physical activities include movement of at least some portion of the body having the resistance garment thereon, anchoring the resistance garment at the wrists and ankles, the resistance elements providing resistance to the movement during the physical activities to tend to burn calories in excess of the calories that are burned during the same physical activities when only the clothing is worn, and wearing the clothing and resistance garment continuously for an extended period of time.

17. The process of claim 16 including anchoring the resistance garment at the wrists and ankles by securing the arms of the garment to gloves and securing the arms of the garment to gloves and securing the legs of the garment to footwear.

18. The process of claim 16 including anchoring the resistance garment at the wrists and ankles by securing the arms to hand loops and securing the legs of the garment to foot stirrups.

19. The process of claim 16 including anchoring the resistance garment at the wrists and ankles by securing the arms and legs of the garment to compressive cuffs.

20. The process of claim 19 including anchoring the resistance garment at the waist by a compressive waistband.

21. In an energy expenditure garment having a body portion and arms and legs portions wherein elongated elastic resistance elements are included in said garment to provide a force that resists movement of the user to cause the user to expend energy to oppose the force provided by the elastic resistance elements for enhancing the exercise value of a physical activity, the improvement being in that said elongated elastic resistance elements are in said body portion and in said arms and legs portions, said elongated elastic resistance elements being incorporated in a variable resistance fabric, said variable resistance fabric including a plurality of generally parallel first strands, said variable resistance fabric further including a plurality of generally parallel second strands perpendicular to said first strands, said second strands being elastic and having greater resistance force than the resistance force of said first strands, and said second strands comprising said elastic resistance elements.

22. The garment of claim 21 wherein said garment is a one piece suit having upper body and lower body portions and arms and leg portions.

23. The garment of claim 21 wherein said garment is a two piece suit having separate shirt and pants portions.

24. The garment of claim 23 wherein said elastic resistance elements are secured to anchoring structure.

25. The garment of claim 21 wherein the entire garment is made of said variable resistance fabric.

* * * * *